United States Patent [19]

Yamaguchi

[11] 4,267,589

[45] May 12, 1981

[54] ELECTRONIC WATCHES

[75] Inventor: Tetsuo Yamaguchi, Yokohama, Japan

[73] Assignee: Tokyo Shibaura Denki Kabushiki Kaisha, Japan

[21] Appl. No.: 79,058

[22] Filed: Sep. 26, 1979

[30] Foreign Application Priority Data

Oct. 18, 1978 [JP] Japan ..... 53-127292

[51] Int. Cl.[3] ..... G04F 8/00; G04C 17/00; G04C 21/16; G08B 3/00

[52] U.S. Cl. ..... 368/109; 368/110; 368/239; 368/251; 340/384 E

[58] Field of Search ..... 58/23 R, 38 R, 39.5, 58/152 R, 152 B; 235/92 T; 364/705, 900; 340/384 E; 368/72, 73, 107–111, 239, 250–251

[56] References Cited

U.S. PATENT DOCUMENTS

| | | | |
|---|---|---|---|
| 3,999,050 | 12/1976 | Pitroda | 58/152 R |
| 4,031,693 | 6/1977 | Haag et al. | 58/38 R |
| 4,162,610 | 7/1979 | Levine | 58/152 R |

*Primary Examiner*—Vit W. Miska

*Attorney, Agent, or Firm*—Finnegan, Henderson, Farabow, Garrett & Dunner

[57] ABSTRACT

There are provided a frequency divider for dividing the frequency of the frequency signal produced by an oscillator, a counter for counting the number of the frequency divided fundamental signal, an input circuit for prestoring a time to be announced in a memory device so as to operate an alarm device, a comparator for comparing the time counted by the counter with a preset time, an input circuit supplied with a message so as to display the message concurrently with the operation of the alarm device, a character memory device for storing the applied message, and a display device for displaying the stored message. The content of the counter is compared with the time to be announced preset in the memory device. When a coincidence holds a buzzer is operated and at the same time a predetermined message preset in the character memory device is displayed on the display device.

6 Claims, 11 Drawing Figures

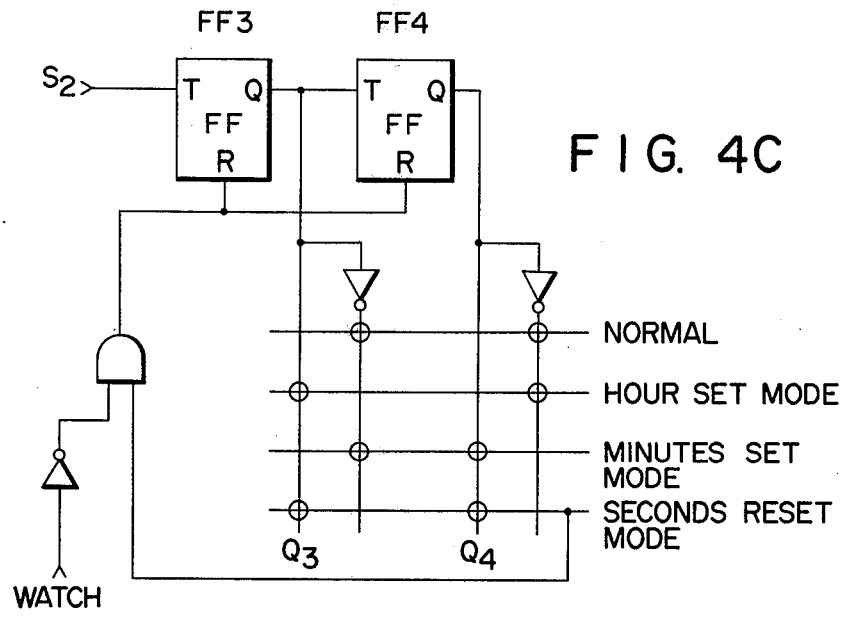
FIG. 4C
FIG. 4D
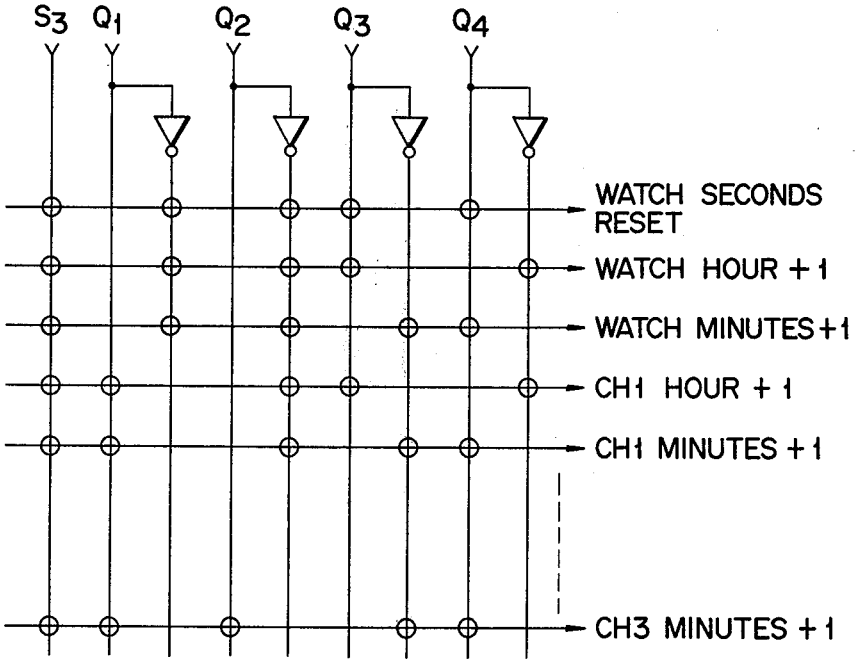

ELECTRONIC WATCHES

This invention relates to an electronic watch, more particularly an electronic watch having an alarming function and capable of displaying a content (schedule preset in a memory device) at a predetermined time concurrent with the alarming.

Electronic wrist watches, particularly digital display wrist watches are now used extensively. These watches utilize integrated circuits as the electronic circuits, and liquid crystal cells or light emitting diodes as the display elements. In a small IC chip of only several square millimeters are contained complicated circuits that display or tell not only time, but also act as a stop watch, display times at different places in the world, and perform as a calculator.

However, appearance of electronic watches having additional functions has been desired strongly.

For example, it is desired to add a mechanism that can reduce wasteful time encountered in daily works.

There are many wasteful times in our daily schedule usually we behave according to prescribed schedule which is written in a note book, a diary, memorandam paper etc. but do not always watch them constantly.

To meet such requirement a wrist watch has been proposed in which a memory function is added to use it as a memorandam as disclosed, for example in Japanese laid open patent specification No. 63062/1978, dated June 6, 1978. In this watch any digits (for example telephone number) are preset in a memory device by a push button or a stem and the digits are read out and displayed when necessary.

With this watch, however, only digits can be stored and the display of the digits is made without any relation to time display.

It is an object of this invention to provide an improved electronic watch having a schedule performance.

Another object of this invention is to provide an electronic watch provided with a program display function capable of displaying a predetermined behavior of one day according to a time schedule.

Yet another object of this invention is to provide an electronic watch that can display programmed times together with alarms.

According to this invention there is provided an electronic watch comprising an oscillator for generating a timing reference signal; a frequency division means for dividing the frequency of the reference signal produced by the oscillator; counter means connected to the frequency dividing means for counting the number of the outputs of the frequency dividing means; announcing time setting means for setting a time to be announced; first memory means connected to the announcing time setting means for storing the time to be announced set by the announcing time setting means; character input means comprising a plurality of types of characters; character input control means connected to the character input means for encoding characters applied by the character input means; second memory means connected to the character input control means for storing the encoded characters; display means connected to the counter means and to the second memory means for displaying the contents of the characters stored in the counter means, the preset time and the second memory means; comparator means for detecting coincidence of a time counted by the counter means and a preset time stored in the first memory means; and time announcing means connected to the comparator means for generating an alarm signal in accordance with a coincidence detection signal generated by the comparator means; whereby when the time to be announced and stored in the first memory means coincides with the time counted by the counter means, the alarm is generated by the time announcing means while at the same time the characters stored in the second memory means are displayed.

In the accompanying drawings:

FIGS. 4A through 4D show detailed connection diagrams showing an input circuit for setting announced times and an input control circuit for setting announced times;

Figure 1:
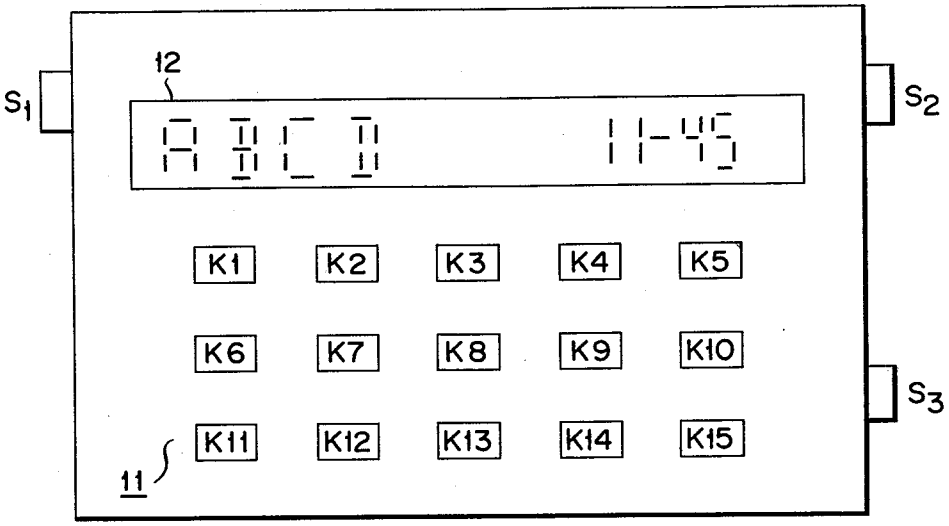
FIG. 1 is a diagrammatic representation of one embodiment of this invention.

A watch diagrammatically illustrated in FIG. 1 comprises a keyboard 11 acting as an input section which is constituted by a plurality of keys representing English characters and digits. For the sake of simplicity only fifteen keys k1 through k15 are shown.

Schedule messages keyed-in by these keys k1 through k15 are stored in a memory device, not shown, and at a preset time, a memory content is read out of a corresponding location of the memory device and displayed on the left hand half of a display unit 12. In the example shown, four letters A, B, C and D are being displayed. On the right hand half of the display unit 12 the present time is being displayed, (in this example, hours and minutes).

Various functions of one embodiment of the illustrated watch are controlled by a plurality of stems $S_1$, $S_2$ and $S_3$.

The stem $S_1$ constitutes a channel switch of the memory device. The term "channel" is used herein to means a memory region for storing one message (in this embodiment 4 characters). Assume now that the memory has 3 channels. Then each time the stem $S_1$ is depressed contents of channels 1, 2 and 3 are sequentially read out and displayed on the display unit 12.

Stem $S_2$ is used as a selection switch for sequentially selecting a normal mode, an hours correction mode, a minutes correction mode and a seconds selection mode.

During the normal mode even when the key is depressed, the counts of the hours, minutes and seconds counters would not vary. Because concurrently with the depression of the key, the contents of the counters are corrected and normally the watch is maintained at the normal mode so that change of the contents of the counters is prevented even when the key is erroneously depressed. When it is desired to correct the zero settings of the hours and minutes, the stem $S_2$ is recurrently depressed to perform the hours correction mode, minutes correction mode and zero second resetting mode together with the correction of hours, minutes, and seconds effected by the stem $S_3$.

Figure 2:
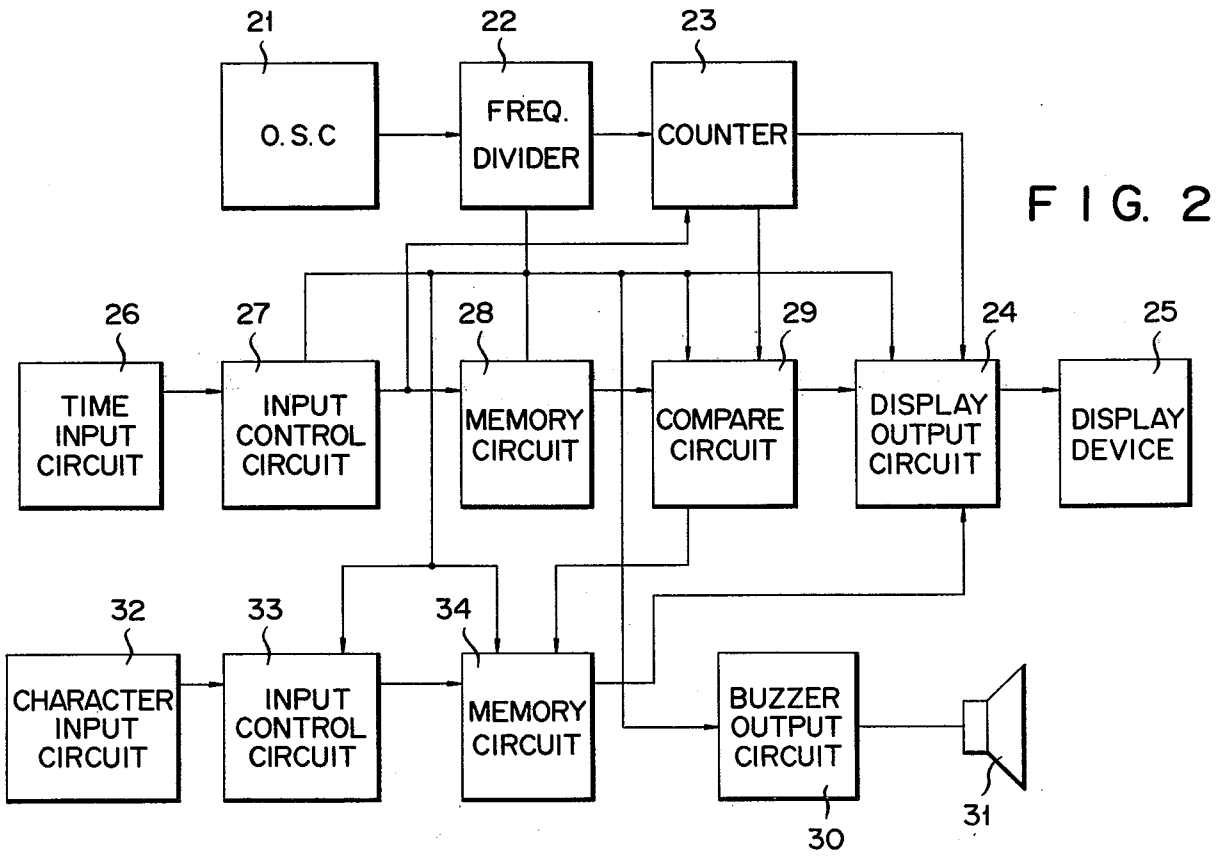
FIG. 2 is a block diagram showing the electronic watch shown in FIG. 1.

FIG. 2 shows the block circuit shown in FIG. 1, in which the output signal of an oscillator 21 is applied to a frequency divider 22. The oscillator 21 is constructed to generate a high frequency signal of 32.768 KHz, for example, and the frequency divider 22 reduces this high frequency to a fundamental frequency of 1 Hz for example. This fundamental frequency of 1 Hz is supplied to a counter circuit 23, which counts the number of the fundamental frequency signals to count seconds, minutes and hours.

Figure 3:
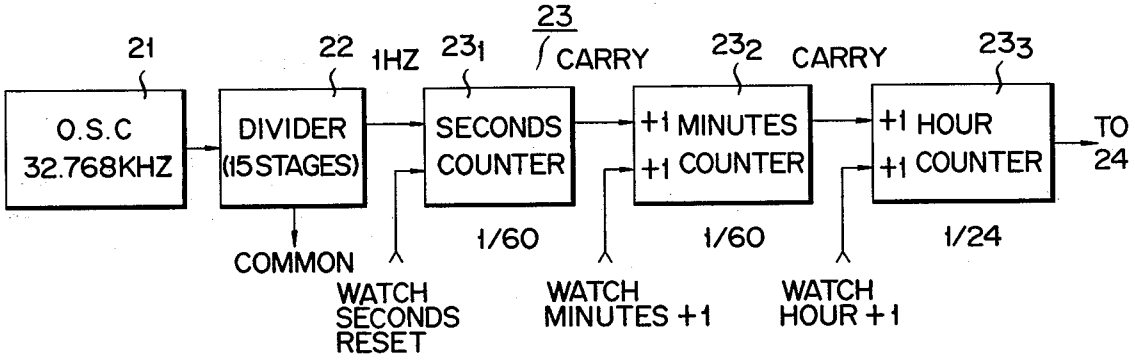
FIG. 3 is a detailed block diagram showing a frequency divider and a counter shown in FIG. 2.

The frequency divider 22 and the counter 23 are constructed as shown in FIG. 3, for example. More particularly, the frequency divider 22 comprises a 15 stage flip-flop circuit to divide the frequency of the signal of 32.768 KHz supplied from the oscillator 21 to 1 Hz which is applied to a second counter $\mathbf{23}_1$ connected to the frequency divider 22. The seconds counter $\mathbf{23}_1$ is constructed to have $10\times6=60$ scale of which 10 scale correspond to one second order while 6 scale correspond to 10 second order.

The content of the seconds counter $\mathbf{23}_1$ is reset to zero by a watch seconds reset signal (a seconds reset signal at the watch mode).

When the count of the second counter $\mathbf{23}_1$ reaches the maximum order, it sends a carry signal to a minutes counter $\mathbf{23}_2$ connected thereto.

Like the seconds counter $\mathbf{23}_1$ the minutes counter $\mathbf{23}_2$ has 60 scale or orders to count the number of minutes when supplied with the carry signal from the seconds counter $\mathbf{23}_1$. Furthermore, the minutes counter is constructed to receive a minutes of +1 signal so that each time the stem $S_3$ is depressed concurrently with the minutes correction mode generated by the stem $S_2$, the minutes counter receives the minutes +1 signal, thus effecting correction of minutes.

When the count of the minutes counter $\mathbf{23}_2$ reaches the full count, it sends a carry signal to an hours counter $\mathbf{23}_3$ connected thereto. The hours counter $\mathbf{23}_3$ has $12\times2=24$ scale of which each 12 scale corresponds to AM and PM at this time, the hours counter $\mathbf{23}_3$ is also applied with the carry signal from the minutes counter $\mathbf{23}_2$ to increment the contents of the counter while at the same time the contents of the hours counter is corrected by the watch hour +1 signal.

The hours and minutes signals produced by the counter circuits are sent to a display output circuit 24 connected to the counter circuit 23. The display output circuit 24 is constituted by a decoder, a driver, etc. for decoding the hours and minutes signals supplied thereto to supply a drive signal to a display device 25 constituted by liquid crystal cells. Of course the display device 25 may be made of light emitting diodes.

Figure 4A:
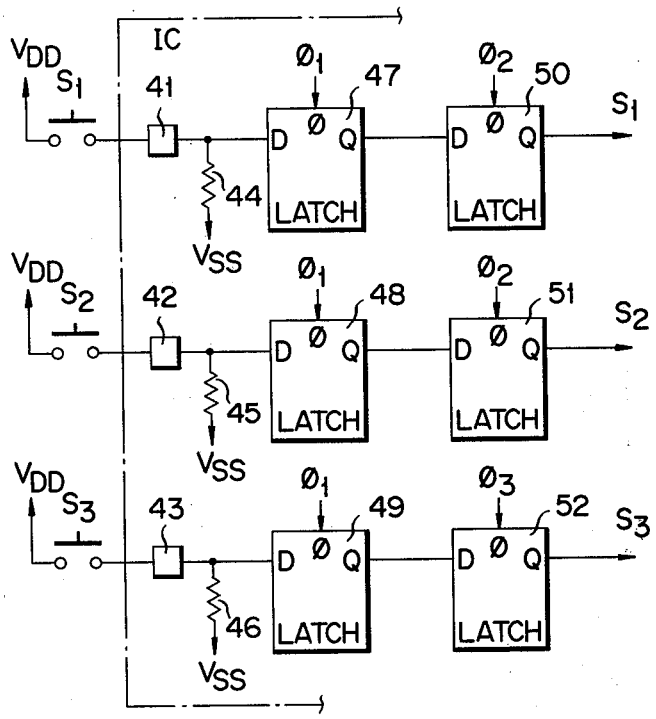
Figure 4B:
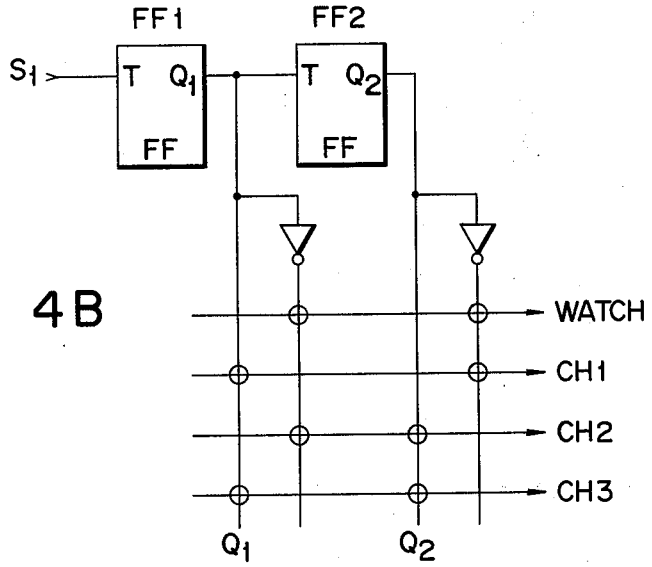

There is provided announcing time setting first input circuit 26 for setting the announcing time setting means. For example, this input circuit 26 is constructed as shown in FIG. 4A.

As shown, stems $S_1$, $S_2$ and $S_3$ are connected to the first and second latch circuits 47, 50, 48, 51, 49 and 52 respectively through IC terminals 41, 42, 43 and pull down resistors 44, 45 and 46 connected to a source of potentials. When stems $S_1$, $S_2$ and $S_3$ are all open, the signals are pulled down to a $V_{ss}$ level by the pull down resistors in the integrated circuits. However, when the stems $S_1$, $S_2$ and $S_3$ are depressed, the integrated circuits are connected to a source of $V_{DD}$ level.

$\phi_1$ and $\phi_2$ represent latch clock signals for maintaining synchronism. Two flip-flop circuits operated by the stem $S_1$ form four modes of a watch mode, a channel 1, a channel 2 and a channel 3. More particularly, when the $Q_1$ output and the $Q_2$ output of two flip-flop circuits $FF_1$ and $FF_2$ are (0, 0), the watch mode is selected whereas when (1, 0), the channel 1 is selected. Similarly when the output is (0, 1) the channel 2 mode is selected whereas when it is (1, 1) the channel 3 mode is selected.

On the other hand, when stem $S_2$ is depressed, as shown in FIG. 4C, when the $Q_3$ output and the $Q_4$ output of the flip-flop circuit $FF_3$ and $FF_4$ are (0, 0), the normal mode is selected, whereas when (1, 0) the hours correction mode is selected. Similarly when the outputs are (1, 0) the minutes correction mode is selected whereas when the outputs are (1, 1) the seconds reset mode is selected.

Further, when the stem $S_3$ is depressed, a watch hour +1 signal, a watch minute +1 signal and a watch seconds reset signal are formed so as to stepwisely advance hours, minutes, and return seconds to zero in accordance with the modes formed by the flip-flop circuits $FF_1$ through $FF_4$.

The output signal produced by the input circuit 26 is supplied to an input control circuit 27 connected thereto. The input control circuit 27 comprises encoder, etc. for example, to encode signals produced by the input circuit 26 and to supply the encoded signals to a memory circuit 28 which is connected to the input control circuit 27 to store the encoded signals produced thereby.

Further, a comparator 29 is connected to the memory circuit 28 and the counter circuit to compare the count of the counter 23 with the time announcing set signal from the memory circuit to produce a coincidence detection signal when a coincidence is obtained.

This coincidence detection signal is sent to a buzzer output circuit 30 connected to the coincidence detection circuit 29 to produce a buzzer signal through a loudspeaker 31.

The circuit shown in FIG. 2 is also incorporated with means for storing a schedule. The schedule measuring means comprises a character input circuit 32 adapted to receive 26 English characters of A through Z. For making clear the feature of this invention, although the character input circuit 32 is shown independently of the announcing time set input circuit 26, the latter circuit may be constructed to act also as the announcing time setting input circuit 26. Characters applied by the character input circuit 32 are applied to an input control circuit 33 connected to the character input circuit 32.

The input control circuit 33 comprises an encoder or the like for encoding character signals from the character input circuit 32 and applied the encoded signals to a memory circuit 34 connected to the control circuit 33 so as to sequentially store the encoded characters in the memory circuit 34.

The memory circuit 34 is also connected to the comparator 29 to read out the content of the memory circuit 34 in accordance with the coincidence detection signal from the comparator 29 for supplying the read out contents to a display output circuit 24 for displaying it on the display device 25. At this time, the announcing time is applied to the display output circuit 24 from the comparator 29 to display the announced time on the display device 25.

Figure 5:
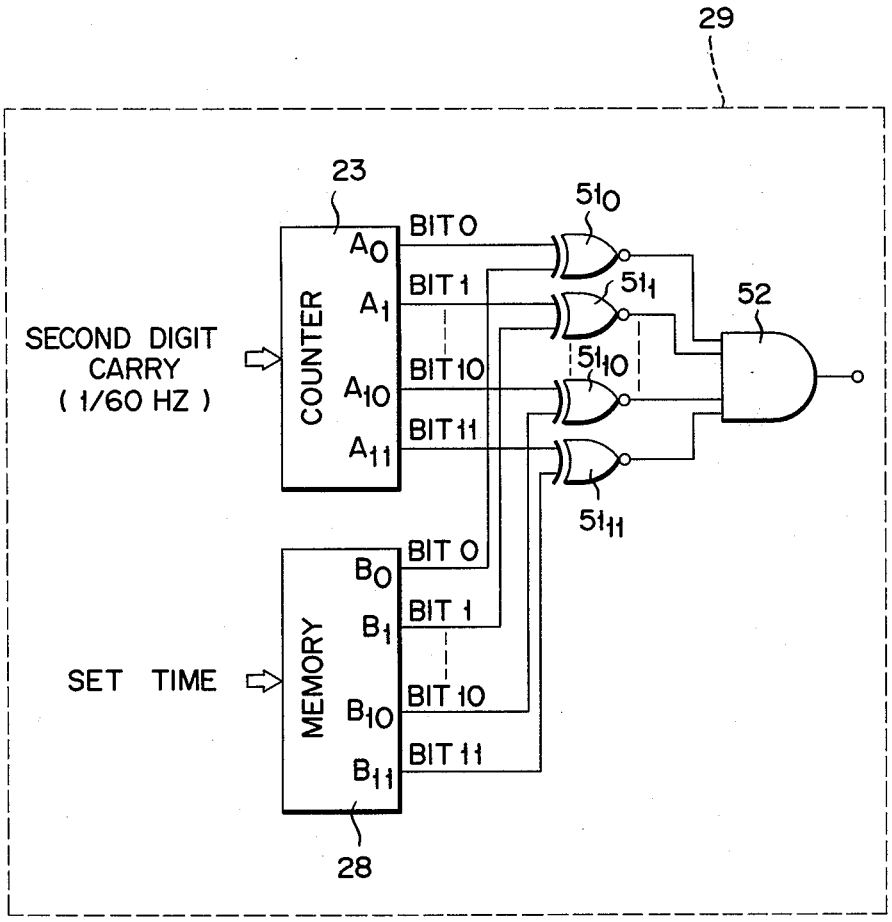
FIG. 5 is a detailed block diagram showing the comparator shown in FIG. 2.

FIG. 5 shows the detail of the comparator 29. As shown, the hours and minutes counter 23 comprises 12 bits, that is the hours counter comprises 5 bits, while the 10 minutes counter comprises 3 bits and a minutes counter 4 bits. Consequently, the time announcing setting memory circuit 28 is also constituted by 12 bits like the counter 23.

Respective output signals $A_0$ through $A_{11}$ and output signals $B_0$ through $B_{11}$ of the time announcing setting memory circuit are applied to respective input terminals of coincident OR gate circuits $\mathbf{51}_0$ through $\mathbf{51}_{11}$. When the values of the counter circuit 23 and of the memory circuit 28 coincide with each other, that is output $A_0$ and $B_0$ are both "0" or "1" and in the same manner when the output $A_1$ through $A_{11}$ and outputs $B_1$ through $B_{11}$ are both "0" or "1", each of the coincident OR gate circuits $\mathbf{51}_0$ through $\mathbf{51}_{11}$ produces a signal having a logical level of "1". These "1" signals are applied to the inputs of an AND gate circuit 52 whereby the AND gate circuit 52 produces a signal "1" that is a coincidence detection signal.

In this embodiment, since the announcing time setting counter 23 comprises an hours and minutes counter, the value of the counter 23 would be incremented one minute later. Accordingly, a buzzer is operated by the buzzer circuit 30 for one minute.

Figure 6:
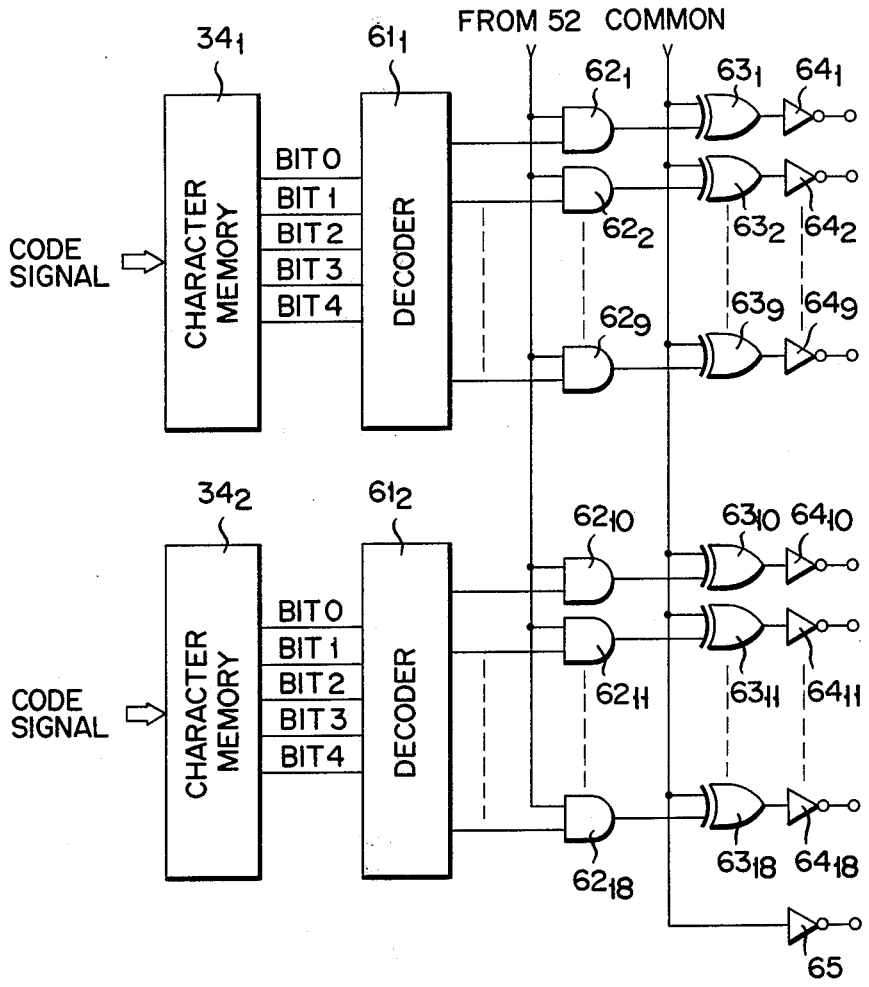
FIG. 6 is a character read out circuit showing a portion of a character memory circuit.
Figure 7:
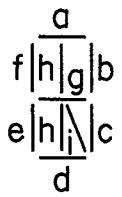
FIG. 7 shows an arrangement of 9 display segments.
Figure 9:
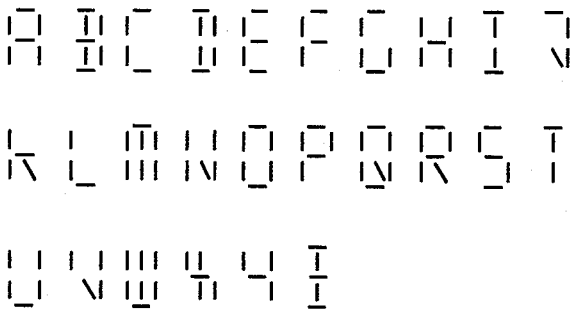
FIG. 9 shows a font of alphabets each displayed by 9 display segments.

FIG. 6 is a block diagram showing the detail of a character drive out circuit. For the sake of simplicity each alphabet character comprises 9 display segments as shown in FIG. 7, and FIG. 6 shows circuits for two characters.

The display device is shown as comprising liquid crystal cell of two digit construction and the circuit is statically driven.

The character signals each comprising 5 bits produced by character memory devices $\mathbf{34}_1$ and $\mathbf{34}_2$ are supplied to decoders $\mathbf{61}_1$ and $\mathbf{61}_2$ respectively connected to the memory devices $\mathbf{34}_1$ and $\mathbf{34}_2$. The decoders $\mathbf{61}_1$ and $\mathbf{61}_2$ decode character signals supplied thereto and their output signals are applied to one inputs of AND gate circuits $\mathbf{62}_1$ through $\mathbf{62}_{18}$. The other inputs of these AND gate circuits are applied by the coincidence signal produced by the AND gate circuit 52 of the comparator 29 shown in FIG. 5. Consequently, when the announcing time previously stored in the time announcing setting memory circuit 28 coincides with an actual time counted by the counter 23, the AND gate circuits $\mathbf{62}_1$ through $\mathbf{62}_{18}$ produce decoded character signals.

These character signals are supplied to respective one inputs of exclusive OR gate circuits $\mathbf{63}_1$ through $\mathbf{63}_{18}$, while a common signal produced by the frequency divider 22 shown in FIG. 3 is applied to the other inputs of these exclusive OR gate circuits $\mathbf{63}_1$ through $\mathbf{63}_{18}$. Consequently, direct current signals from the AND gate circuits $\mathbf{62}_1$ through $\mathbf{63}_{18}$ are converted into AC signals which are inverted and amplified by buffer amplifiers $\mathbf{64}_1$ through $\mathbf{64}_{18}$. These signals are supplied to the display device 25 constituted by liquid crystal cells to display a desired message.

Figure 8:
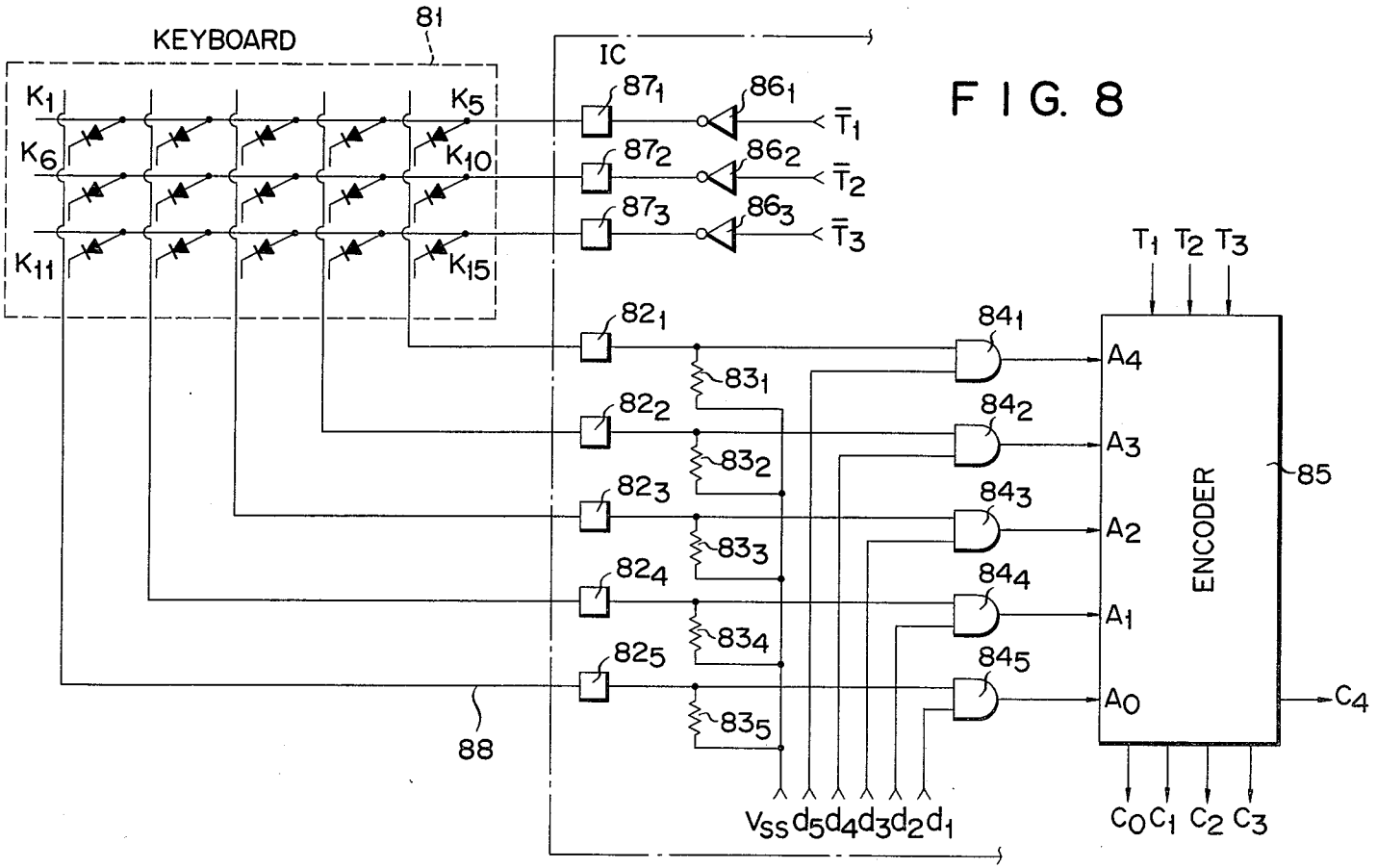
FIG. 8 is a detailed connection diagram showing the character input circuit and character input control circuit shown in FIG. 2.

FIG. 8 shows the detail of the character input circuit 32 and the character input control circuit 33. For the sake of simplicity the number of keys is limited to 15 ($K_1$ through $K_{15}$). Portions 81 bounded by dashed lines show a keyboard section of the character input circuit 32.

For example, the keyboard section 81 is made up of a diode matrix circuit comprising three rows and 5 columns. Input lines extending in the column direction of the keyboard section 81 are connected to respective one inputs of AND gate circuits $\mathbf{84}_1$ through $\mathbf{84}_5$ via terminals $\mathbf{82}_1$ through $\mathbf{82}_5$ of integrated circuits IC (generally constituted by custom LSI) and pull down resistors $\mathbf{83}_1$ through $\mathbf{83}_5$ which are connected to a source of a $V_{SS}$ level, where as the other inputs of these AND gate circuits $\mathbf{84}_1$ through $\mathbf{84}_5$ are supplied with dynamic signals $d_1$ through $d_5$. The output signals of these AND gate circuits $\mathbf{84}_1$ through $\mathbf{84}_5$ are applied to input terminals $A_0$ through $A_4$ of the encoder 85.

The input lines in the row direction of the diode matrix circuit are supplied with timing signals $T_1$, $T_2$ and $T_3$ from the integrated circuits IC via inverters $\mathbf{86}_1$ through $\mathbf{86}_3$ and output terminals $\mathbf{87}_1$, $\mathbf{87}_2$ and $\mathbf{87}_3$ respectively.

Figures 10A, 10B, 10C, 10D, 10E, 10F, 10G, 10H:
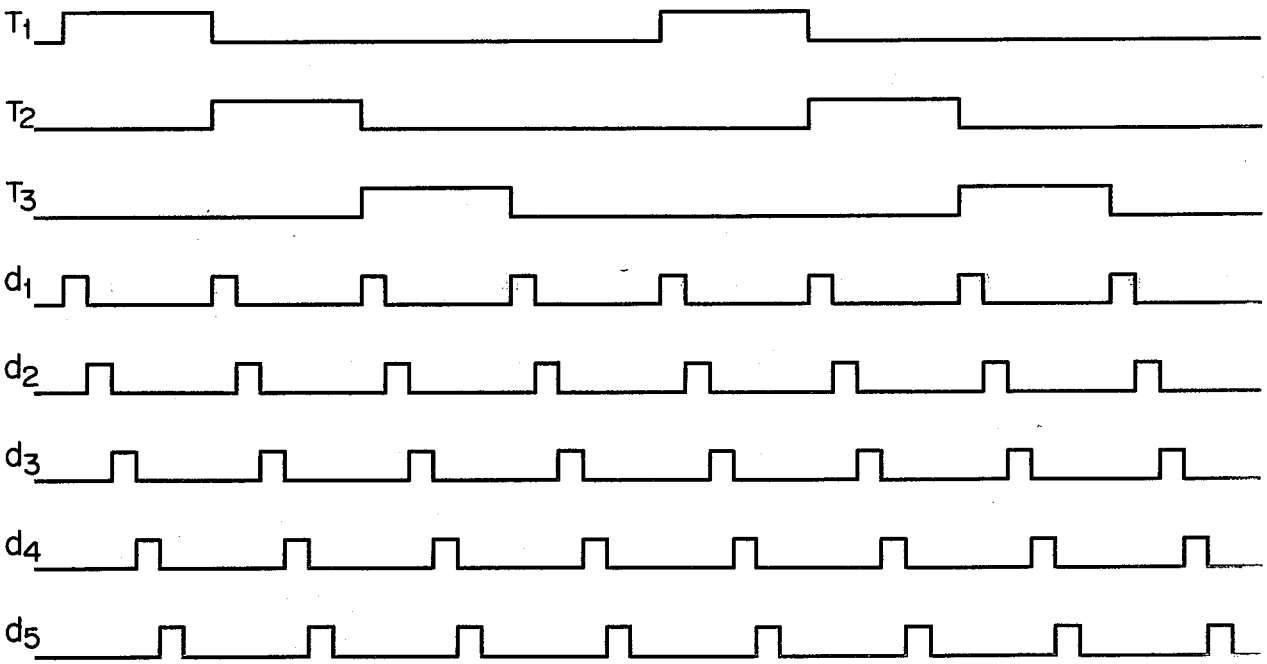
FIGS. 10A through 10H are time charts showing timing signals $T_1$, $T_2$, $T_3$ and $d_1$, $d_2$, $d_3$, $d_4$ and $d_5$.

Suppose now that a key $K_1$ is depressed, a timing signal $T_1$ in a row direction would be applied to terminal $\mathbf{82}_5$ via line 88 so as to apply timing signals $T_1$ and $d_1$ as shown in FIGS. 10A and 10D to the AND gate circuit $\mathbf{84}_5$ whereby this AND gate circuit $\mathbf{84}_5$ applies the output signal of $T_1d_1$ to the input terminal $A_0$ of the encoder 85.

In the same manner, when key $K_2$ is depressed, an output signal $T_1d_2$ as shown in FIGS. 10A and 10E would be applied to the input terminal $A_1$ of the encoder 85 via AND gate circuit $\mathbf{84}_4$. Upon depression of the key $K_{15}$, an output signal $T_3d_5$ as shown in FIG. 10C and FIG. 10H would be applied to the input terminal $A_4$ of the encoder 85 via AND gate circuit $\mathbf{84}_1$.

The encoder 85 functions to convert respective input signals to the memory circuit into output signals $C_0$ through $C_3$ in accordance with the timing signals described above. For example, when a signal $T_1d_1$ is applied to the input terminal $A_0$ of the encoder $\mathbf{85}_1$ the decoder decodes this input signal into output signals $C_0$, $C_1$, $C_2$ and $C_3$ supplied to the memory circuit 34 thus producing a signal 0, 0, 0, 1 which corresponds to a character "A". On the other hand, when a signal $T_1d_2$ is applied to the input terminal $A_1$ of encoder 85, a signal 0, 0, 1, 0 would be produced as output signals $C_0$, $C_1$, $C_2$ and $C_3$, which correspond to a character "B".

As above described, by writing output signals $C_0$, $C_1$, $C_2$ and $C_3$ into the memory circuit 34 at proper timings, characters corresponding to respective keys would be stored in the memory circuit 34.

The output signal $C_4$ is applied to an address counter, not shown, of the memory circuit 34 so as to increment the count of the address counter. The content of the address counter and the channel number determines a location into which the data is to be written.

FIGS. 11A through 11G show some examples of the display of the display device 25 in which messages are displayed up to a maximum of 7 characters.

Figure 11A:
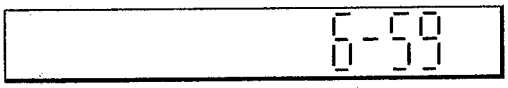
FIG. 11A is a diagram for explaining a normal mode display.
Figure 11B:
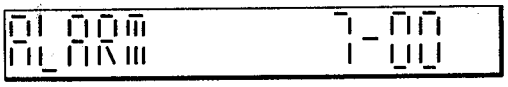
FIGS. 11B through 11G are diagrams respectively explaining scheduled messages.
Figure 11C:
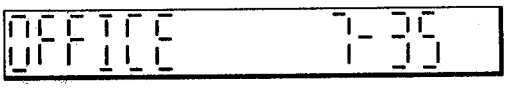
Figure 11D:
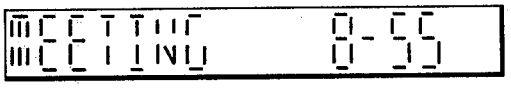
Figure 11E:
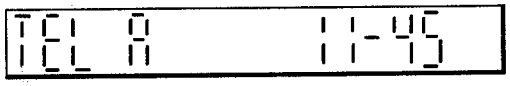
Figure 11F:
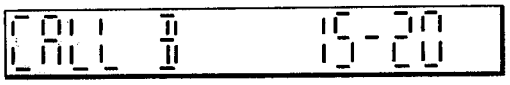
Figure 11G:
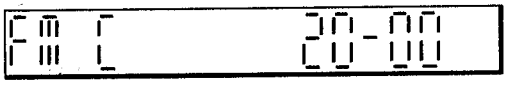

FIG. 11A shows a display under the normal mode. Thus, under the normal mode, no message is displayed and only a time (in this example, hours and minutes) is displayed.

Where a schedule, for example, get up at 7:00, go to the office at 7:35, attend a conference at 8:55, telephone to A before noon, go out at 15:20 to visit B, listen a program of an FM broadcasting station C at 20:00 is preset, the buzzer is operated for one minute at respective preset times so that messages shown in FIGS. 11B through 11G will be displayed together with preset times.

According to this invention, an electronic watch can be provided which can display a predetermined schedule together with times, so that it is not necessary to carry a schedule note book or forget to carry it.

Where the electronic clock of this invention is interlocked with a time switch of a radio or television receiver, it is possible to display channel numbers, frequencies, and programs but also possible to preselect a desired station and programs.

It should be understood that the invention is not limited to the specific embodiments described above and that many changes and modifications will be obvious to one skilled in the art without departing from the true spirit and scope of the invention.

For example, while the drive circuit shown in FIG. 6 is of a static type it may be constructed as a dynamic type.

What is claimed is:

1. An electronic watch comprising:

an oscillator for generating a timing reference signal;

frequency dividing means for dividing the frequency of the reference signal produced by said oscillator;

counter means connected to said frequency dividing means for counting the number of the outputs of said frequency dividing means;

announcing time setting means for setting a time to be announced;

first memory means connected to said announcing time setting means for storing the time to be announced set by said announcing time setting means;

character input means comprising a plurality of types of characters;

character input control means connected to said character input means for encoding characters supplied by said character input means;

comparator means for detecting coincidence of a time counted by said counter means and a preset time stored in said first memory means, and for producing a signal in response to the detection of such coincidence;

second memory means connected to said character input control means for storing said encoded characters, said second memory means comprising decoder means for decoding the encoded characters produced by said second memory means, a first gate circuit group for producing the output signals produced by said decoder means in accordance with the coincidence detection signal produced by said comparator means, a second gate circuit group for effecting DC-AC conversion of the output signals produced by said first gate circuit group, and a character drive out circuit comprising a group of buffer amplifiers for amplifying the output signals from said second gate circuit group;

display means connected to said counter means and to said second memory means for displaying the contents of the characters stored in said counter means, said preset time and said second memory means; and time announcing means, connected to said comparator means for generating an alarm signal in accordance with the coincidence detection signal generated by said comparator means, whereby when the time to be announced and stored in said first memory means coincides with the time counted by said counter means, the alarm is generated by said time announcing means while at the same time the characters stored in said second memory means are displayed.

2. An electronic watch comprising:

an oscillator for generating a timing reference signal;

frequency dividing means for dividing the frequency of the reference signal produced by said oscillator;

counter means connected to said frequency dividing means for counting the number of the outputs of said frequency dividing means;

announcing time setting means for setting a time to be announced;

first memory means connected to said announcing time setting means for storing the time to be announced set by said announcing time setting means;

character input means comprising a plurality of types of characters;

character input control means connected to said character input means for encoding characters supplied by said character input means, said character input control means comprising a plurality of pull down resistors for setting a plurality of input signals to source potential level, a plurality of AND gate circuits, each with one input connected to receive said input signals and the other input connected to receive said timing signals, and an encoder for encoding output signals from said plurality of AND gate circuits;

second memory means connected to said character input control means for storing said encoded characters;

display means connected to said counter means, and to said second memory means for displaying the contents of the characters stored in said counter means, said preset time and said second memory means;

comparator means for detecting coincidence of a time counted by said counter means and a preset time stored in said first memory means, and for producing a signal in response to the detection of such coincidence; and time announcing means, connected to said comparator means for generating an alarm signal in accordance with the coincidence detection signal generated by said comparator means, whereby when the time to be announced and stored in said first memory means coincides with the time counted by said counter means, the alarm is generated by said time announcing means while at the same time the characters stored in said second memory means are displayed.

3. The electronic watch, according to claims 1 or 2 wherein said counting means comprises a seconds counter, a minutes counter, and an hours counter.

4. The electronic watch according to claims 1 or 2 wherein said display means comprises liquid crystal cells.

5. The electronic watch according to claims 1 or 2 wherein said comparator means comprises a group of coincident OR gate circuits enabled by the coincident logical sum of the output signals from said counter means, and the output signal from said first memory means, and an AND gate circuit enabled by the outputs of said group of the coincidence OR gate circuits.

6. The electronic watch according to claims 1 or 2 wherein said character input means comprises a diode array.

* * * * *